US006167833B1

(12) United States Patent
Caraway et al.

(10) Patent No.: US 6,167,833 B1
(45) Date of Patent: Jan. 2, 2001

(54) WEAR INDICATOR FOR ROTARY DRILLING TOOLS

(75) Inventors: Douglas Bruce Caraway, Kingwood; Tony Martin Watts, Houston; Douglas Alan Patton, Houston; David Martin Nguyen, Houston, all of TX (US)

(73) Assignee: Camco International Inc., Houston, TX (US)

( * ) Notice: Under 35 U.S.C. 154(b), the term of this patent shall be extended for 0 days.

(21) Appl. No.: 09/183,504

(22) Filed: Oct. 30, 1998

(51) Int. Cl.[7] ..... G01D 21/00; E21B 12/02; E21B 12/04

(52) U.S. Cl. ..... 116/208; 175/39

(58) Field of Search ..... 116/208; 175/374, 175/39, 40, 410

(56) References Cited

U.S. PATENT DOCUMENTS

| | | | | |
|---|---|---|---|---|
| 1,788,941 | * | 1/1931 | Bradley et al. | 116/208 |
| 2,239,106 | * | 4/1941 | Krall | 116/208 |
| 2,549,278 | * | 4/1951 | Yancey | 116/208 |
| 2,562,833 | * | 7/1951 | Truz | 116/208 |
| 2,580,860 | * | 1/1952 | Stokes | 116/206 |
| 3,797,451 | * | 3/1974 | Tiraspolsky et al. | 116/208 |
| 3,865,736 | | 2/1975 | Fries | 252/11 |
| 3,964,211 | * | 6/1976 | Engle | 51/2 C |
| 4,473,125 | * | 9/1984 | Addudle et al. | 175/410 |
| 4,548,280 | | 10/1985 | Daly et al. | 175/40 |
| 4,610,313 | | 9/1986 | Daly et al. | 175/40 |
| 4,773,263 | | 9/1988 | Lesage et al. | 73/151 |
| 4,785,894 | | 11/1988 | Davis, Jr. et al. | 175/39 |
| 4,785,895 | * | 11/1988 | Davis, Jr. et al. | 175/39 |
| 4,926,950 | | 5/1990 | Zijsling | 175/39 |
| 5,027,913 | * | 7/1991 | Nguyen | 175/336 |
| 5,961,185 | * | 10/1999 | Friant et al. | 175/365 |
| 5,967,245 | * | 10/1999 | Garcia et al. | 175/374 |
| 5,992,546 | * | 11/1999 | Heinrich et al. | 175/374 |
| 5,992,547 | * | 11/1999 | Caraway et al. | 175/385 |
| 6,015,248 | * | 1/2000 | Elliott et al. | 408/204 |
| 6,062,325 | * | 5/2000 | Taylor et al. | 175/393 |
| 6,073,711 | * | 7/2000 | Ingmarsson | 175/420.2 |
| 6,102,140 | * | 8/2000 | Boyce et al. | 175/374 |
| 6,105,694 | * | 8/2000 | Scott | 175/428 |

FOREIGN PATENT DOCUMENTS

| | | | | |
|---|---|---|---|---|
| 1965131 | * | 11/1979 | (DE) | 116/208 |
| 2 335 161 | | 9/1999 | (GB) . | |
| 618525 | | 7/1979 | (SU) . | |
| WO 94/24539 | | 10/1994 | (WO) . | |
| WO 99/28590 | | 6/1999 | (WO) . | |

OTHER PUBLICATIONS

Translated Abstract of SU 618525, Titled "Diamond drill bit—has wear indicator as insert dissimilar from die in properties and colour, placed radially, with length equal to die endface" issued Jul. 21, 1979, obtained from DialogIP through Dwewent World Patents Index.

* cited by examiner

*Primary Examiner*—G. Bradley Bennett
*Assistant Examiner*—Gail Verbitsky
(74) *Attorney, Agent, or Firm*—Jeffrey E. Daly

(57) ABSTRACT

A wear indicator is provided for a rotary drilling tool of the type which comprises a bit body having a leading surface for cutting, abrading or reaming a hole in a target substrate material such as a sub-surface formation, the wear indicator comprising or including one or more discrete areas of a visually distinct material to that from which the drilling tool is mainly composed, the visually distinct material being arranged or configured at or adjacent the surface of the bit such that progressive wear of the bit and hence the or each visually distinct discrete area provides a visual indication of surface wear of the tool.

10 Claims, 1 Drawing Sheet

WEAR INDICATOR FOR ROTARY DRILLING TOOLS

BACKGROUND OF THE INVENTION

1. Field of the Invention

This invention relates to rotary drilling tools such as drilling bits for drilling sub-surface formations although the invention is not limited to such and may find application in other types of rotary drilling tools used above ground.

2. Description of Related Art

As is well known, a drill bit for drilling sub-surface formations can comprise a steel core around which the main part of the bit body, providing its leading face, is formed such as by a powder metallurgy process. In this process the steel core is located in an appropriately shaped mould which is then packed with particulate matrix-forming material which may be powdered tungsten carbide. Pieces of suitable copper or other alloy are then placed above the packed particulate material and the whole assembly is placed in a furnace so that the alloy fuses and infiltrates downwardly through the carbide particles so as to form, upon cooling, a solid body of infiltrated matrix material in the shape of the mould. The abrasive particles with which the matrix material is impregnated commonly comprise superhard materials such as diamond particles.

Other types of rotary drill bits are also comprised of a bit body for attaching to a source of rotary movement such as a power-operated chuck, and having leading edges for cutting, abrading or reaming of a relatively hard material.

Whatever the construction of the rotary drill bit, a problem with such is that due to their construction the measurement of wear on the external surface is inherently difficult to determine so that as the bit is used and then re-used the risk of failure due to wear becomes progressively greater. Since the failure of a drill bit must be avoided at all costs it is often preferred to discard such drill bits at a relatively early stage rather than take the risk of failure even though the drill bit may, in reality, still be well within acceptable limits in terms of wear so that it is discarded unnecessarily.

It is an object of the present invention to provide a wear indicator for rotary drilling tools such as drilling bits, core bits, reamers and undereamers, etc. in which the aforementioned disadvantages are obviated and by which the rate of wear can be easily and conveniently determined by visual inspection of the tool.

SUMMARY OF THE INVENTION

According to a first aspect of the invention there is provided a rotary drilling tool comprising a bit body having a leading surface for cutting, abrading or reaming a hole in a target substrate material such as a sub-surface formation, wherein at least part of the bit body and/or leading surface comprises or includes one or more discrete areas of a visually distinct material to that from which the drilling tool is mainly composed, the visually distinct material being arranged or configured at or adjacent the surface of the bit such that progressive wear of the bit and hence the or each visually distinct material provides a visual indication of surface wear.

Preferably, the relatively visually distinct material is embedded in outer surface portions of the bit in a graduated manner so as to indicate the level of wear thereof, such as in a step formation with the exposure of each step indicating the progression of wear in the bit.

Alternatively, the visually distinct material may be wedge-shaped with the apex of the wedge pointing outwards relative to the axis of rotation of the drill bit so that initially the thin end of the wedge is at or adjacent the surface of the drill bit and as where progresses the worn edge of the wedge becomes progressively thicker larger or longer, thereby indicating the extent of wear. In a further alternative construction the wedge shaped visually distinct material may point inwardly relative to the axis of rotation of the drill bit so that as wear progresses the worn edge becomes progressively thinner, shorter or smaller.

Advantageously, where the visually distinct material is embedded into one or more outer surface portions of the bit the size and shape thereof may correspond with the depth of wear so that if, for example, the visually distinct material is wedge shaped with the wedge subtending an angle of 45°, the increasing length of the worn end of the wedge corresponds to the wear depth of the drill bit.

Since the primary purpose of the invention according to the first aspect is to make the assessment of wear in a drilling tool very simple by reference solely to the visual indication of wear on the or each discrete areas of visually distinct material, it will be apparent that any suitable material can be used for this purpose, provided it is visually distinct from the material from which the drilling tool is mainly composed and, by way of example only, such visually distinct material may be stainless steel, brass, aluminium, tungsten, graphite, ceramic, etc.

According to a second aspect of the invention there is provided a method of indicating wear on the outer surface of a rotary drilling tool, such as a drill bit, the method including the steps of providing one or more areas of a visually distinct material to that from which the drilling tool is mainly composed, the visually distinct material being arranged or configured at or adjacent the surface of the bit, and as wear proceeds measuring the amount of visually distinct material visible at the surface of the tool to thereby indicate the amount of surface wear.

BRIEF DESCRIPTION OF THE DRAWINGS

The invention will now be described, by way of example only, with reference to the accompanying drawings in which.

DETAILED DESCRIPTION OF THE DRAWINGS

Figure 1:
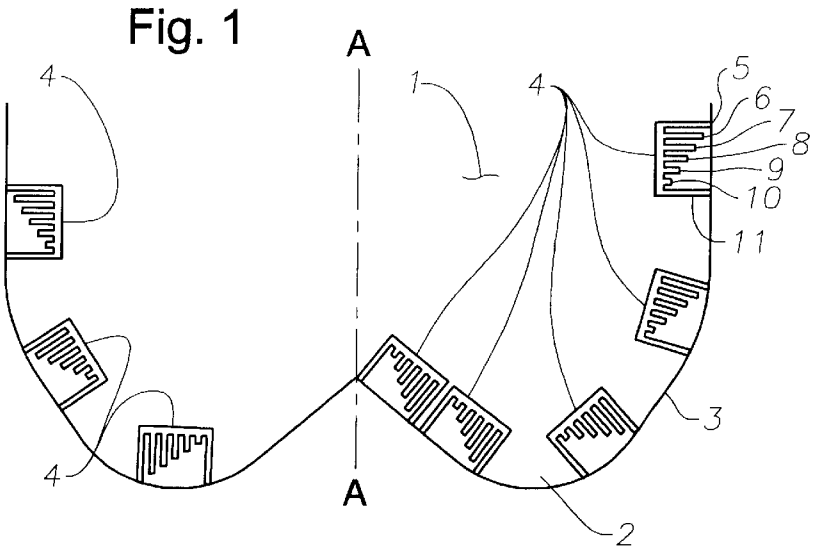
FIG. 1 is a schematic sectional view along the rotational axis of a drilling bit incorporating a first embodiment of the invention.

Referring firstly to FIG. 1 there is shown the lower half only of a rotary drill bit 1 about which is formed an outer bit body 2 comprising abrasive particles impregnated within a matrix material in a conventional manner to provide a leading face 3 of a relatively hard material to that of the core (not shown) such that upon rotation about the axis "A—A" the drill bit 1 can be used for drilling sub-surface formations in a conventional manner.

In accordance with this first embodiment of the invention, at spaced intervals around the outer surface of the bit body 2 are wear indicators 4 in the form of wafers of a visually distinct material to that from which the drilling tool is mainly composed, the wear indicators 4 being cast or otherwise embedded into the outer bit body 2. Each indicator 4 comprises or includes a set of outwardly facing fins 5,6,7,8,9 and 10, with each of fins 6 to 10 being progressively shorter than the previous one by a predetermined amount, and a marker fin 11 of length corresponding to fin 5, each of which are always visible at the leading face 3 of the drill bit, thereby initially indicating that the drill bit is so far unused and therefore not worn if none of the other fins 6–10 are visible.

As will be apparent from the drawing, wear at a given radial position and hence the outer bit body 2 will gradually expose, in sequence, fins 6, 7, 8, 9 and 10, thereby indicating the level of wear at that given radial position without the need to separately measure the level of wear. Accordingly, if the length of pairs of adjacent fins differ by, say, 2 mm the depth of wear can be measured by reference to the number of fins visible at the surface. Hence, visual inspection of the leading face 3 of the outer bit body 2 provides a simple and convenient way by which the level of wear in the drill bit can be determined.

Figure 2:
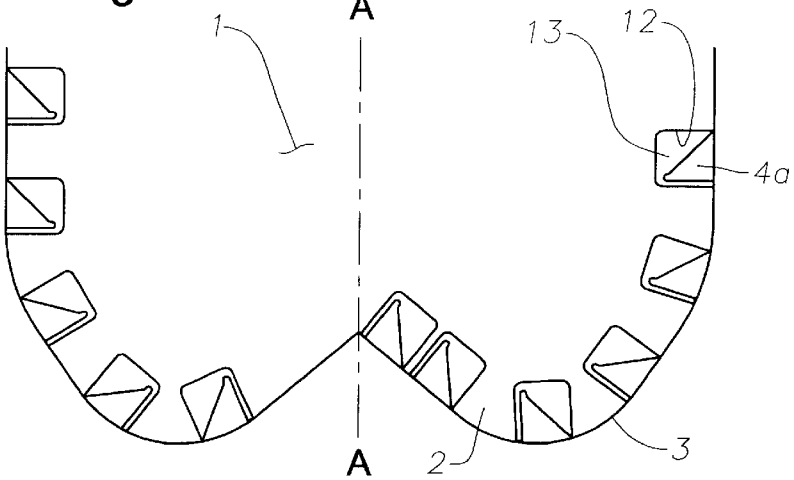
FIG. 2 is a sectional view along the rotational axis of a drilling bit showing a second embodiment of the invention.

Turning now to FIG. 2, there is shown an alternative embodiment of the invention in which wear indication is obtained in each case by the use of a triangular wear indicator 4*a* at spaced intervals around the outer bit body, each being retained therein by being bonded to substrate 13 of fused solid infiltrated matrix material. As will be apparent, in this embodiment wear of the leading face 3 can be ascertained by visual inspection of the wear indicator 4*a* and in particular the width of the exposed portion, which becomes thinner as wear progresses, with the narrowest portion of the wear indicator 4*a* corresponding to a completely worn and therefore unacceptable rotary drill bit.

Figure 3:
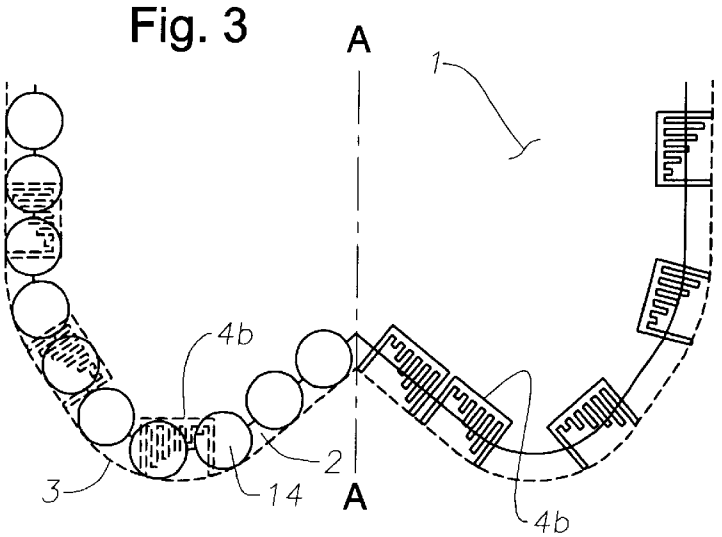
FIG. 3 is a sectional view along the rotational axis of a drilling bit in accordance with a third embodiment of the invention.

Turning now to FIG. 3, there is shown an embodiment of the invention particularly useful for indicating wear in drilling bits of the type incorporating disc-shaped cutters 14 embedded in leading surfaces of a bit body. The wear indicators 4*b* common in this embodiment of the invention are secured immediately behind each of the cutting discs 14 in the manner as shown in dotted outline to the left of the drawing and perform the same function as the wear indicators 4 shown with reference to FIG. 1. Accordingly, as wear of the leading face 3 progresses visual inspection of a wear indicator 4*b* at any given point around the outer surface of the drill bit will directly indicate the amount of wear without recourse to more complicated forms of measurement of such wear.

Figure 4:
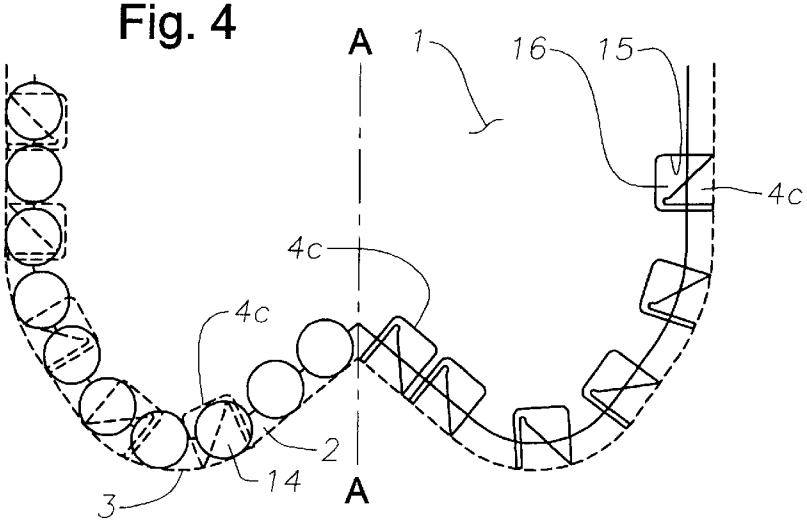
FIG. 4 is a sectional view along on the rotational axis of a drilling bit incorporating a fourth embodiment of the invention.

A fourth embodiment of the invention is shown with reference to FIG. 4 which generally corresponds to FIG. 3 except that in this instance the wear indicators 4*c* are comprised of wafers having a cross-sectional shape corresponding to the wear indicators 4*a* shown with reference to FIG. 2. These are each embedded within correspondingly shaped slots 15 and are retained therein by being embedded within a solid infiltrated matrix material 6 in a manner corresponding to that shown with reference to FIG. 2. Similarly, in this embodiment of the invention, wear of the leading face 3 of the outer bit body 2 is ascertained visually by reference to the thickness, length or size of the visible portion of the wear indicator 4*c* which progressively becomes thinner, shorter or smaller in accordance with the amount of wear.

The invention therefore provides an elegantly simple solution to the otherwise complicated problem of determining the amount of wear at various points around the external surfaces of a drilling bit, although it will be understood that the invention is not specifically limited to drilling bits for use in drilling sub-surface formation and may be equally applicable to other forms of drilling operations and drilling bits without departing from the spirit or scope of the invention.

Whereas the present invention has been described in particular relation to the drawings attached hereto, it should be understood that other and further modifications, apart from those shown or suggested herein, may be made within the scope and spirit of the present invention.

What is claimed:

1. A rotary drilling tool comprising:

a bit body having an outer surface for penetrating the earth; and at least one wear-indicating member embedded within the bit body, the wear-indicating member including a plurality of fins arranged in parallel to each other, with a predetermined number of the fins proportionally varying in length;

wherein the extent of wear on the outer surface of the bit body is indicated by the number of fins that are exposed at the outer surface of the bit body.

2. The rotary drilling tool of claim 1 wherein each of the predetermined number of fins are proportionally shorter in length by a predetermined amount than each adjacent fin.

3. The rotary drilling tool of claim 1 wherein the wear-indicating member is composed of one of stainless steel, brass, aluminum, tungsten, graphite, and ceramic.

4. A method for indicating wear on a rotary drilling tool, the tool including a bit body having an outer surface for penetrating the earth, the method comprising:

providing at least one wear-indicating member embedded within the bit body, the wear-indicating member including a plurality of fins arranged in parallel to each other, with a predetermined number of the fins proportionally varying in length; and indicating the extent of wear on the outer surface of the bit body by the number of fins that are exposed at the outer surface of the bit body.

5. The method of claim 4 wherein providing at least one wear-indicating member further comprises:

providing at least one wear-indicating member embedded within the bit body, the wear-indicating member including a plurality of fins arranged in parallel to each other, with each of a predetermined number of the fins being proportionally shorter in length by a predetermined amount than each adjacent fin.

6. A rotary drilling tool comprising:

a bit body having an outer surface for penetrating the earth and having an axis of rotation; and at least one wedge-shaped member including at least two flat non-parallel walls joining at an apex embedded within the bit body;

wherein the wedge-shaped member indicates the extent of wear of the bit body as portions of the wedge-shaped member are exposed at the outer surface of the bit body.

7. The rotary drilling tool of claim 6 wherein the apex of the wedge-shaped member points outward relative to the axis of rotation of the bit body so that as the outer surface of the bit body wears, the wedge-shaped member becomes wider on the outer surface of the bit body.

8. The rotary drilling tool of claim 6 wherein the apex of the wedge-shaped member points inward relative to the axis of rotation of the bit body so that as the outer surface of the bit body wears, the wedge-shaped member becomes narrower on the outer surface of the bit body.

9. The rotary drilling tool of claim 6 wherein the wedge-shaped member is composed of one of stainless steel, brass, aluminum, tungsten, graphite, and ceramic.

10. A method for indicating wear on a rotary drilling tool, the tool including a bit body having an outer surface for penetrating the earth, the method comprising:

providing at least one wedge-shaped member including at least two flat non-parallel walls joining at an apex embedded within the bit body; and indicating the extent of wear of the bit body as portions of the wedge-shaped member are exposed at the outer surface of the bit body.

* * * * *